US005275244A

United States Patent [19]

Da Silva

[11] Patent Number: 5,275,244

[45] Date of Patent: Jan. 4, 1994

[54] APPARATUS AND PROCESS FOR EXTINGUISHING FIRES WITH A NONCOMBUSTIBLE FLUID IN LIQUID AND GASEOUS STATES

[75] Inventor: Fernando M. Da Silva, Lisbon, Portugal

[73] Assignees: Fernando Jorge Nunes de Almeida; Jorge Maria Bello de Sousa Rego; James Edward Risso-Gill, ; part interest to each

[21] Appl. No.: 875,075

[22] Filed: Apr. 28, 1992

[30] Foreign Application Priority Data

Apr. 29, 1991 [PT] Portugal ..... 97519

[51] Int. Cl.[5] ..... A62C 3/06

[52] U.S. Cl. ..... 169/52; 169/49; 169/69

[58] Field of Search ..... 169/69, 43, 46, 48, 169/49, 52

[56] References Cited

U.S. PATENT DOCUMENTS

| | | | |
|---|---|---|---|
| 1,697,376 | 1/1929 | Wasson | 169/69 |
| 3,685,584 | 8/1972 | Gracia | 169/69 X |
| 4,323,118 | 4/1982 | Bergmann | 169/69 X |
| 5,154,234 | 10/1992 | Carrico | 169/69 X |

FOREIGN PATENT DOCUMENTS

| | | | |
|---|---|---|---|
| 1329060 | 4/1963 | France | 169/69 |
| 856464 | 8/1981 | U.S.S.R. | 169/69 |
| 1062534 | 3/1967 | United Kingdom | 169/69 |
| 2085296 | 4/1982 | United Kingdom | 169/69 |

*Primary Examiner*—David M. Mitchell
*Assistant Examiner*—Andrew C. Pike
*Attorney, Agent, or Firm*—Hale and Dorr

[57] ABSTRACT

The present invention provides an apparatus and process to extinguish fires in oil wells by encircling the nucleus of the fire by creating a barrier of isolation of the fuel. The apparatus expands gases in the gaseous and liquid states and directs such gases upon, under and around the nucleus of fire, encircling it at 360 degrees and isolating it completely from the atmospheric air, while at the same time causing the convenient cooling of the nucleus of fire, thereby avoiding any possibility of auto-ignition. The process and apparatus of extinguishing fires in oil wells either in land or at sea, is also disclosed which uses a derrick type hoist, to place the apparatus around the fire, and to apply simultaneously a non-combustible gas in the liquid state (for example, carbon dioxide $CO_2$, or bromochlorine-difluormetane, or nitrogen or any other commercially known gas like HALON 1211), and the same gas in the gaseous state.

6 Claims, 6 Drawing Sheets

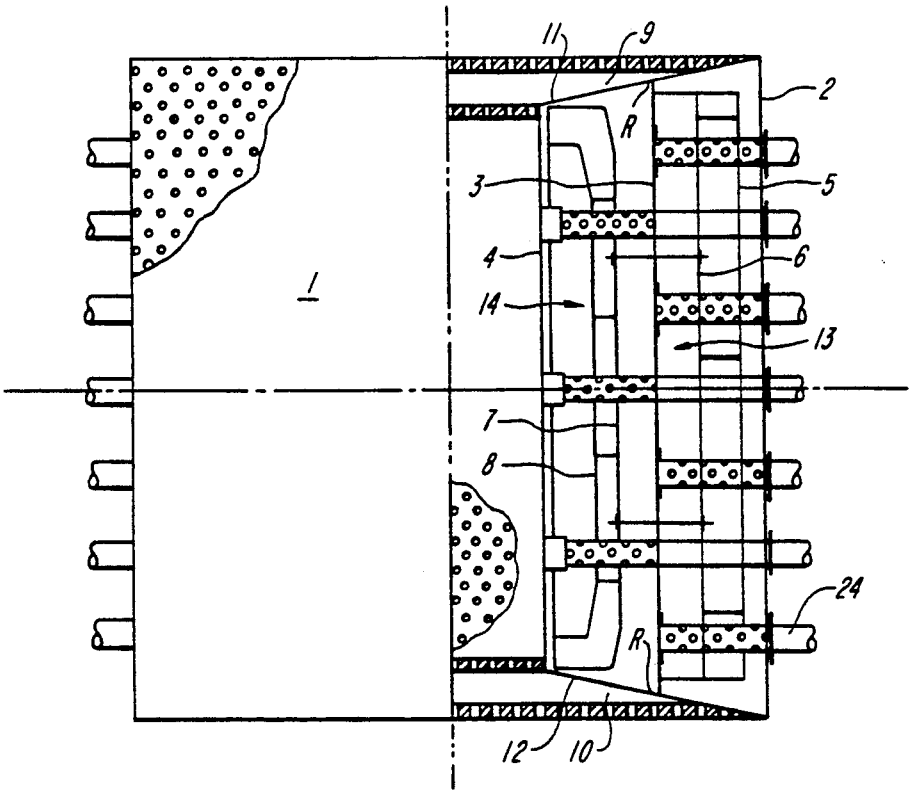
FIG. 1
FIG. 2
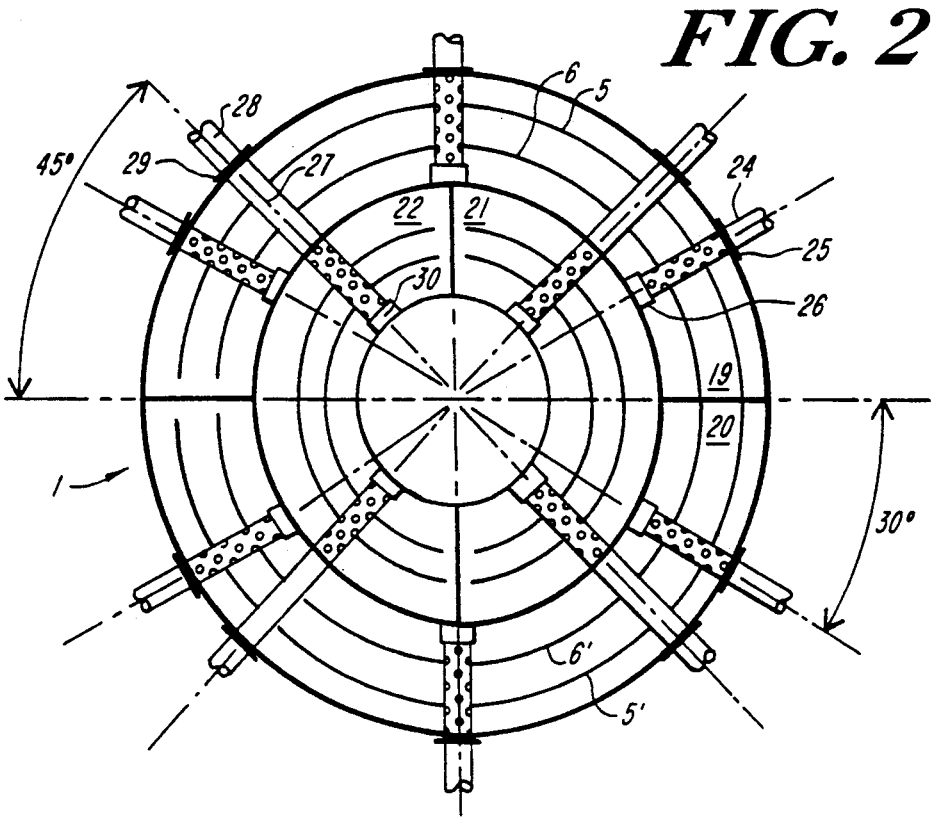

APPARATUS AND PROCESS FOR EXTINGUISHING FIRES WITH A NONCOMBUSTIBLE FLUID IN LIQUID AND GASEOUS STATES

SCOPE OF THE INVENTION

The present invention relates to an apparatus and process to extinguish fires in general and, in particular, to extinguish fires in oil wells on land or at sea.

BACKGROUND OF THE INVENTION

Known techniques to extinguish fires in oil wells where the overall pressure is above atmospheric pressure, have mainly relied on the effect of the blow produced by the burst of the explosive charge. These techniques, being extremely dangerous and slow, cause irreparable damage to the material used to set up the charges in position, which makes it also extremely expensive.

It would seem that the raising of an isolating barrier between a combustible and a fuel together with the cooling of the combustible would seem to be a preferable technique to fight such fires, but up to the present, it has not been possible to create this condition in case of fires in oil wells where the overall pressure is above atmospheric pressure.

SUMMARY OF THE INVENTION

One object of the present invention is to provide an apparatus and process to extinguish fires in oil wells where the overall pressure is above atmospheric pressure.

The present invention provides an apparatus and process to extinguish fires in oil wells in which the apparatus comprises a means that make it possible to encircle the fire nucleus, by means of an isolating barrier of the fuel. The barrier is constituted by gases in the liquid state and in the gaseous state that are expanded and projected by the apparatus upon, under and around the nucleus of the fire, at a temperature of 360 degrees centigrade and isolating it completely from the atmospheric air, and causing the convenient cooling of the fire nucleus, eliminating any possibility of auto-ignition.

The invention also provides a process of extinguishing fires in oil wells either in land or at sea, consisting of using a derrick type device, for the simultaneous application of a noncombustible gas in the liquid state (for example, carbon dioxide ($CO_2$), or bromochlorinedifluormetane or nitrogen or any other gas commercially known such as the HALON 1211), and of the same gas in the gaseous state. The gases in the liquid state and in the gaseous state are expanded and projected by means of the apparatus upon, under and around the fire nucleus, at a temperature of 360 degrees centigrade, isolating it completely from the atmospheric air, and causing the convenient cooling of the fire nucleus, eliminating any possibility of auto-ignition.

In accordance with the invention the apparatus includes three walls, which may be, cylindrical, spherical, conical, or any other similar shape with different diameters. The walls are coaxially and concentrically arranged. Separating devices are inserted in the chamber between the wall having the largest diameter and the wall with intermediate diameter, and in the chamber between the wall of intermediate diameter and of the wall with smallest diameter. Two conical surfaces that funnel towards the inside of the apparatus are placed symmetrically over the ends of the walls. The walls, as well as the covers, are perforated. The walls with different diameters form two chambers, one outside chamber and another inside. The inside chambers are displaced relative to the outside chambers by 90 degrees, giving rise to four half chambers.

The walls of the outside half chambers are perforated by radial perforations, displaced from each other at, for example, by approximately 60 degrees. These perforations are designed to receive tubular cannons and their respective joints. The cannons include a plurality of holes into the outside half chambers. There are several layers of these perforations positioned along the height of the apparatus.

The walls of the outside half chambers and inside half chambers are also perforated by radial perforations, displaced from each other, for example, by approximately 90 degrees. These perforations are designed to receive tubular cannons and their respective joints. These cannons include a plurality of holes into the inside half chambers, with no holes into the outside half chambers. There are several layers of these perforations positioned along the height of the apparatus.

The cannons that connect the said outside half chambers are connected, on the outside of the apparatus, to a feeding duct, not shown, which is provided with the joints to feeding hoses, and/or flexible interjoints of a derrick jib, of the "Athey type".

The cannons that connect the said inside chambers are also connected, on the outside of the apparatus, to a feeding duct, which is also not shown and which is provided with connections to flexible feeding hoses to be joined to the jib of the derrick.

The apparatus also includes also a joint support to a jib of a derrick, in which the connections to the flexible feeding hoses of interlinkages can be positioned.

The apparatus is fed by a noncombustible gas in the gaseous state, through a feeding line connected to the entry joints of the feeding duct of the cannons that join the said outside half chambers, and is fed by a noncombustible gas in the liquid state, through a feeding line connected to the joint of the entry of the feeding duct of the cannons that joins the said inside half chambers.

Due to the shape of the said apparatus, the gas in the liquid state is impelled upwards and downwards in a cone shape, with a cylindrical form. The gas is thrown up at the joining basis of the cones.

The gas in the gaseous state is thrown upwards and downwards, also in a cone shape, to encircle the gas that was thrown up in the liquid state, so the gas is also thrown laterally. As a result, the nucleus of fire is surrounded on all sides by a noncombustible, that can outline a barrier zone of more or less 30 meters diameter in the horizontal direction, and with more or less 15 meters in the vertical direction above and below the said fire nucleus. It is understood, from this point of view, that the fire extinguishes instantaneously.

BRIEF DESCRIPTION OF THE DRAWINGS

The invention will be more fully understood from the following description, which should be read in connection with the drawings, in which:

FIG. 1 is a schematic view, partly in section, of the apparatus according to the present invention;

FIG. 2 is a section view of the apparatus shown in FIG. 1 taken along line 2—2 of FIG. 1;

DETAILED DESCRIPTION OF THE PREFERRED EMBODIMENTS

Figure 3A:
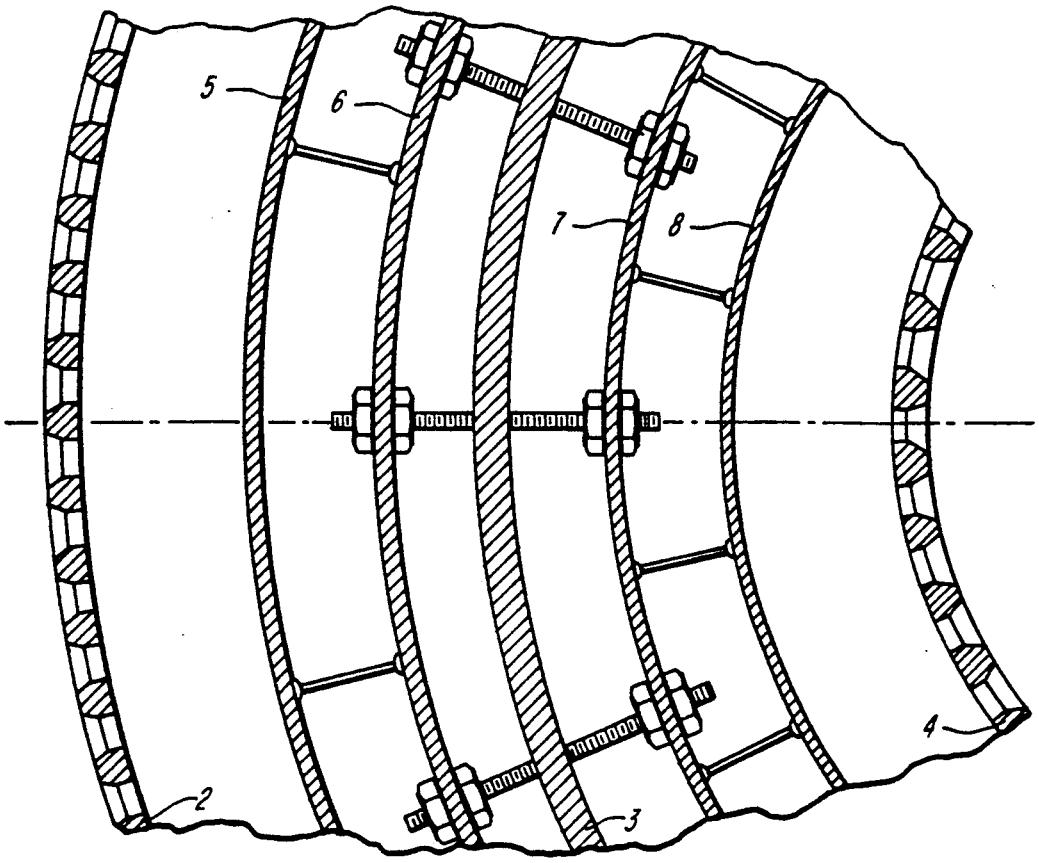
FIG. 3*a* and 3*b* are enlarged sectional views, showing the separators, in the half chambers of the apparatus shown in FIGS. 1 and 2 taken along lines 3*a*—3*a* of FIG. 1 and 3*b*—3*b* of FIG. 2 respectively.

Referring to FIGS. 1 and 2, the apparatus 1 for extinguishing fires according to the present invention comprises three cylindrical wall portions 2, 3 and 4 with different diameters which are concentrically and coaxially arranged. Two semicylindrical separator plates 5, 6, are inserted between the wall 2 the wall 3 and two semicylindrical separator plates 7, 8 are positioned between the wall 3 and the wall 4. Two conical surfaces 9, 10, that narrow into the inside of the apparatus, are symmetrically placed and outline the respective tops of the portions of wall 2, 3 and 4 . Each of the two conical surfaces 9, 10 are covered with a perforated cover 11, 12 which is conically shaped and its conicity is about 10% so that a cone of projection gas may be formed. The wall 2, 4 are fixed by the covers 11, 12 which are screwed to the walls. These covers have a recess R, in which the wall 3 is set. The walls 2, 4 are perforated. The holes in the walls 2, 4 are about 5 mm and will be counter-punched at 30 degrees, up to one third of the thickness of the plate of the wall to allows $CO_2$ to be projected from each hole in a diffused form. The walls 2, 3 and 4 define an external chamber 13 and an interior chamber 14, both chambers being divided by divisions 15, 16 and 17, 18 at displaced relative positions of 90 degrees, from which results four semicylindrical chambers 19, 20, 21 and 22.

The apparatus 1 and all its components, must be made of metallic material that must resist temperatures between 1,500 and 1,800 degrees without changing shape.

The size of apparatus 1 is determined in accordance with the fires and must not be less than three meters in diameter and three meters high. The inside cylindrical wall 4 which surrounds the nucleus of the fire must have a diameter over 1.5 meters.

The semicylindrical chambers 19, 20 are perforated by radial perforations 23, displaced between themselves by about, for example, 60 degrees, which go through wall 2, as well as the separator plates 5, 6 and 5' 6' in the chambers 19 and 20 respectively, and through wall 3.

These perforations stop at wall 3. A tubular manifolds 24 with mounting collars 25 and 26 pass through the perforations 23. Each manifold 24 is perforated with a series of holes into chambers 19, 20.

The semicylindrical chambers 19 and 20 are perforated by other radially positioned holes 27, for instance at 90 degrees angular intervals within the horizontal plane. The holes are drilled in wall 2, semicylindrical separators 5, 6, 5', 6', wall 3 and semicylindrical separators 7, 8, 7', 8'. These holes stop at wall 4 inclusive. Tubular manifolds 28 with mounting collars 29 and 30 pass through the perforations 27. In the area within chambers 21, 22, each manifold 28 is perforated with a series of holes into chambers 21, 22, and there are no holes from the manifold 28 into the area within chambers 19 and 20. There are 4 horizontal planes of manifolds 24 and 3 horizontal planes of minifolds 28. Therefore there will be at least 24 of manifolds 24 and 12 of manifolds 28. The total number of each of the manifolds may be altered.

On the exterior of the apparatus 1 all of the manifolds 24 are linked up to a main manifold which is not shown in FIG. 2. It is equipped with a coupling for a flexible hose. This flexible hose will link the device to a supply of gaseous $CO_2$ or Nitrogen via the jib of an Athey TM type crane.

The manifolds 28 are also linked to a main manifold which is also not shown in FIG. 2. It is equipped with a coupling for a flexible hose. This flexible hose will link the device to a supply of liquid $CO_2$ Nitrogen via the jib of an Athey TM type crane.

Figure 3B:
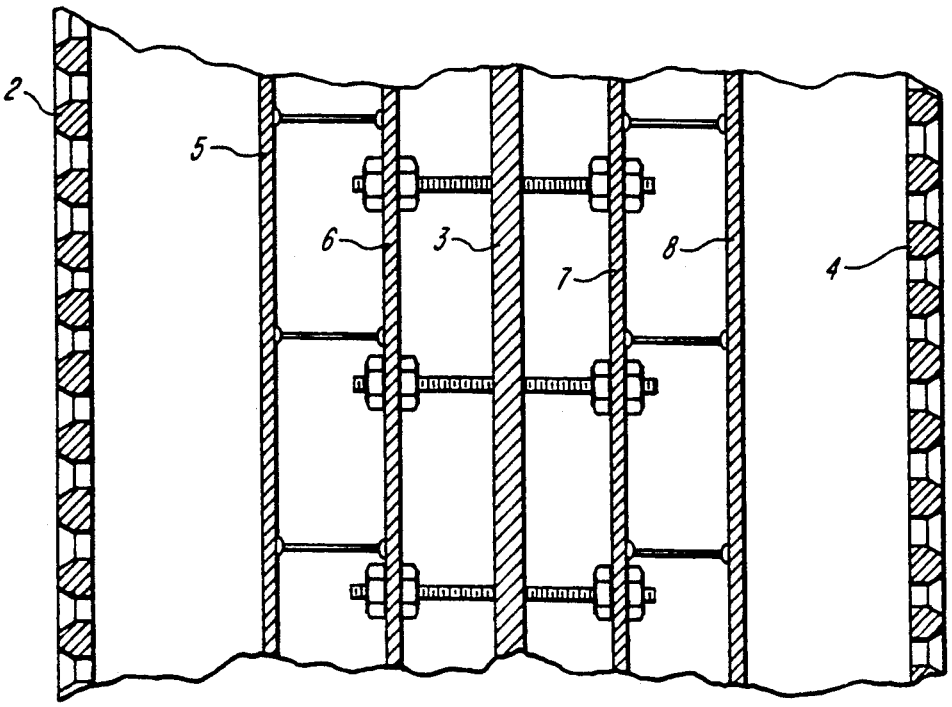

FIGS. 3*a* and 3*b* show the details of the linkage between separating walls 5, 6 and 5' 6'; and 7, 8 and 7' 8' and the way they are fixed to cylindrical wall 3.

Figure 4:
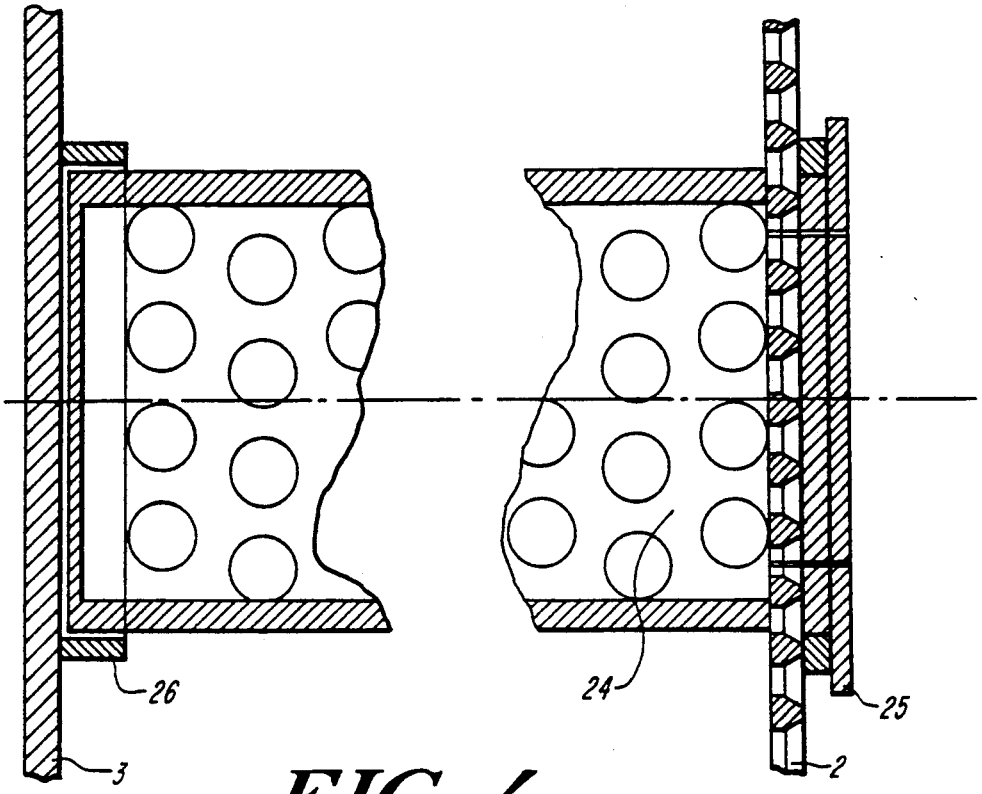
FIG. 4 is a sectional view of a cannon for the gas in the gaseous state of the apparatus shown in FIG. 1 taken along line 4—4 of FIG. 2.
Figure 5:
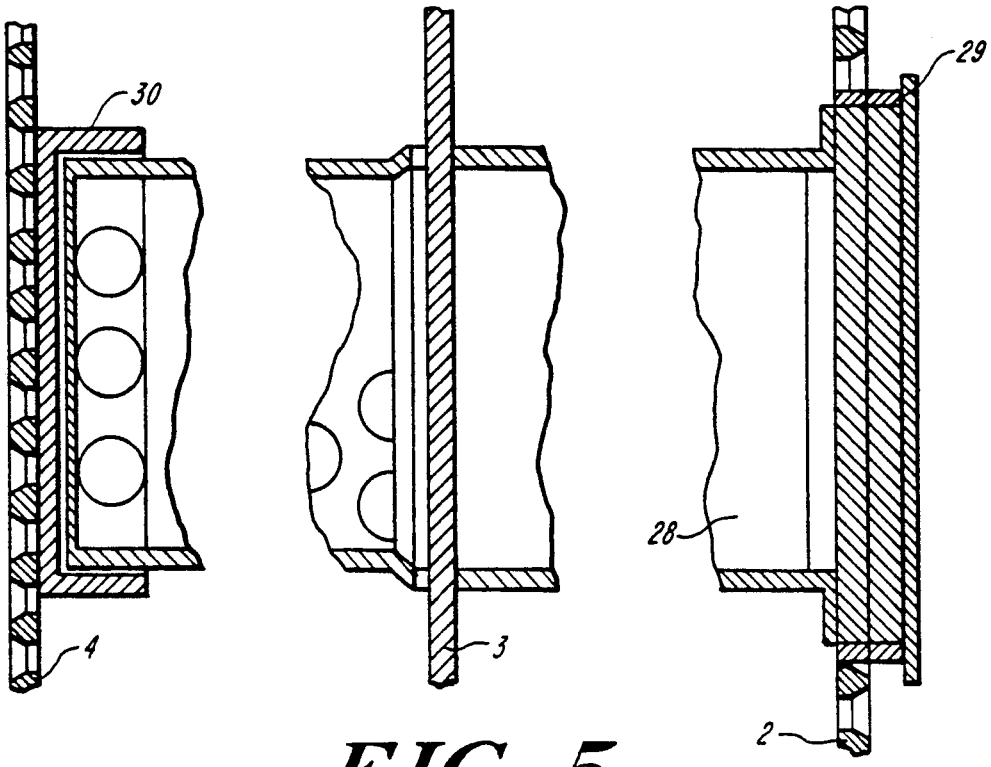
FIG. 5 is a sectional view of a cannon for the gas in the liquid state of the apparatus shown in FIG. 1 taken along line 5—5 of FIG. 2.

FIGS. 4 and 5 show the details of the cannons 24 and 28, as well as the respective packings 25 and 26, 29 and 30.

Figure 6A:
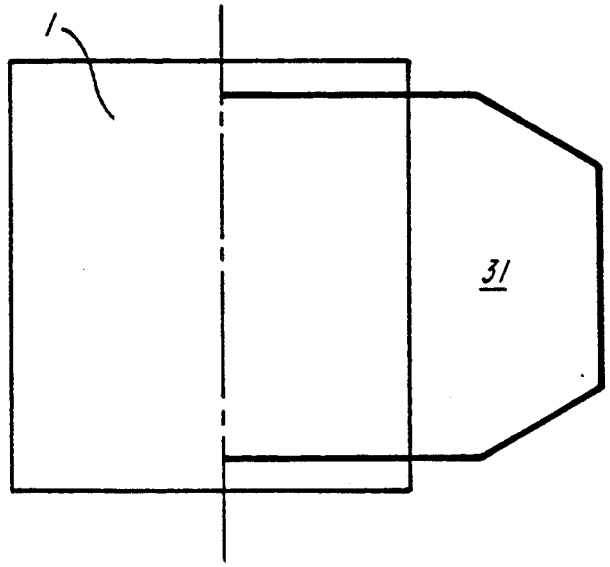
FIGS. 6*a* and 6*b* are side elevational and top plan views respectively of the apparatus housing and support of the present invention.
Figure 6B:
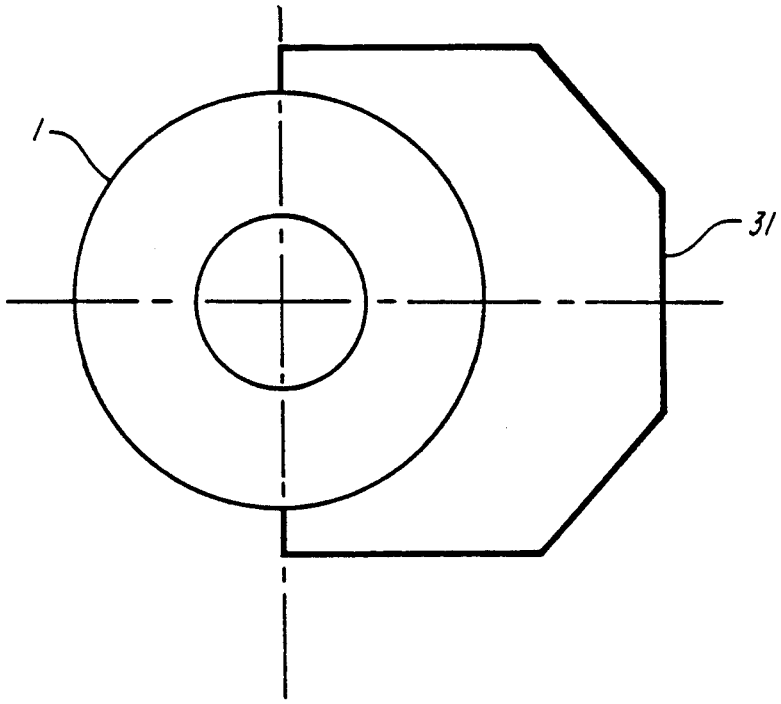

FIG. 6 shows a support 31 fixed to the apparatus 1 for connecting the apparatus 1 to a jib of a derrick, for example, of the Athey TM type, in which one finds the connections to flexible feeding hoses of the apparatus 1.

The apparatus 1 is fed with $CO_2$ in the gaseous state, through a feeding line connected to an entry joint of the feeding duct of the cannons 24 that are connected to the said semicylindrical chambers 19 and 20. The apparatus is fed with $CO_2$ in the liquid state, through a feeding line connected to the entry joint of the feeding duct of the cannons 28 that are connected to the said semicylindrical chambers 21, 22.

Figure 7:
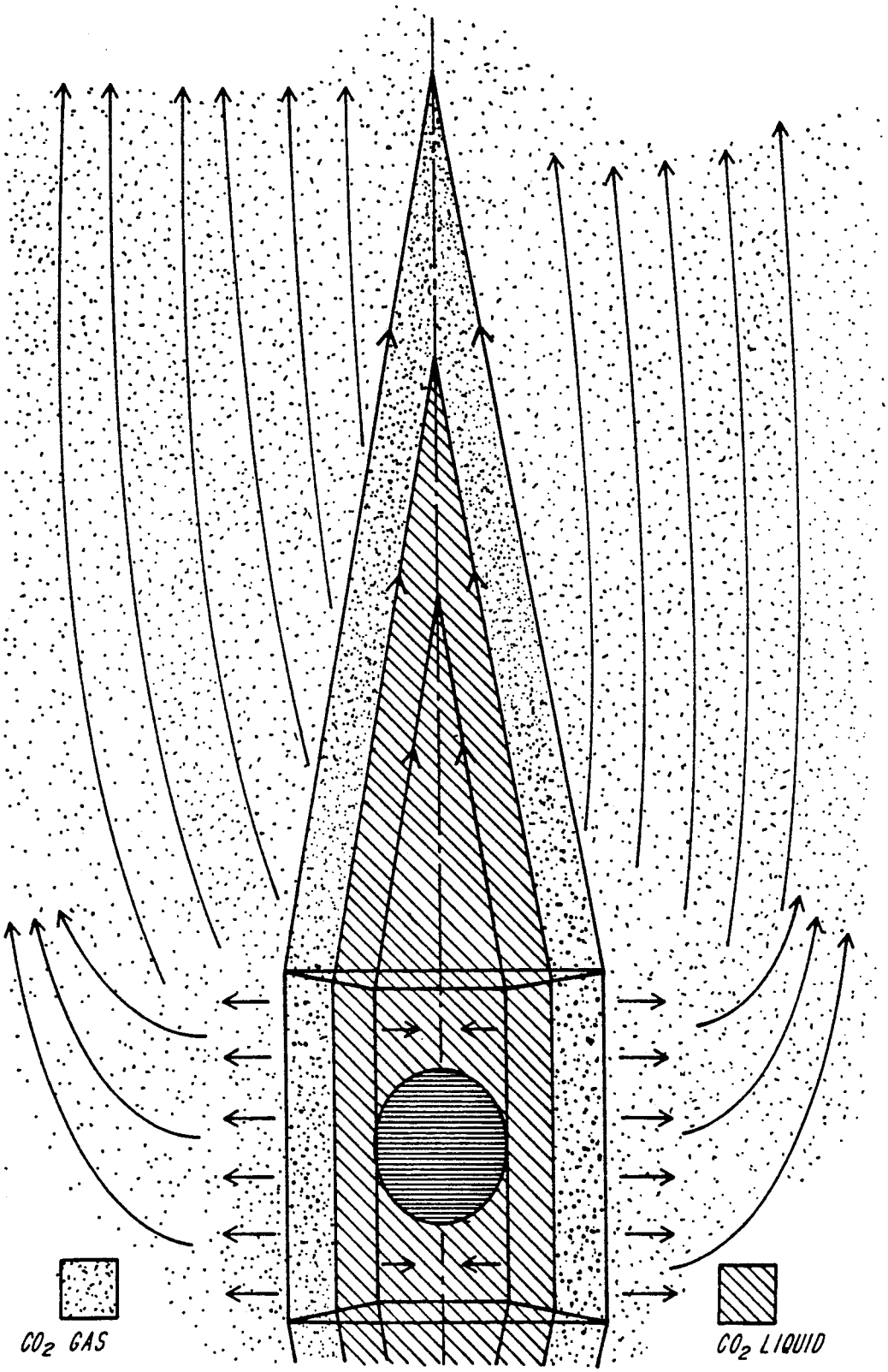
FIG. 7 is a schematic view of the process to extinguish a fire nucleus using the apparatus of the present invention.
Figure 8:
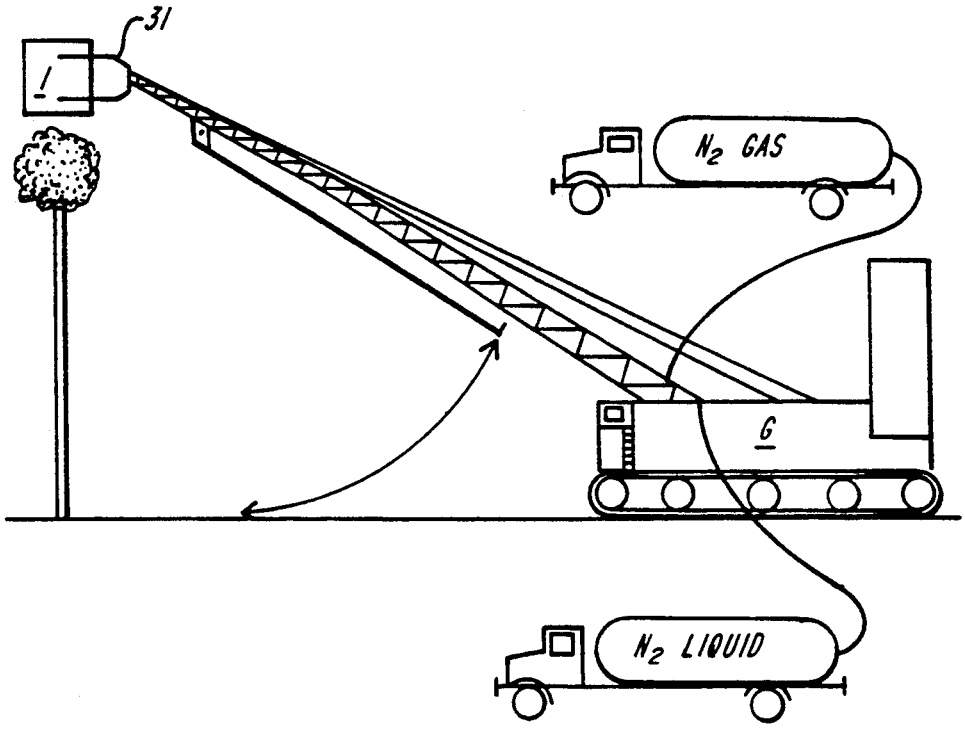
FIG. 8 is a generic schematic representation of the apparatus to extinguish the fires in oil wells.

As shown in FIG. 7 which shows part of the process according to the invention, the $CO_2$ in the gaseous state is fed into the interior of the said chambers 19 and 20 by means of the cannons 24 and is projected upwards and downwards, with a conical shape, and also laterally, involving the $CO_2$ in the liquid state, which is fed into the interior of the said chambers 21 and 22 through cannons 28, where the $CO_2$ is projected upwards and downwards, in a cone shape with a cylindrical form with the gas being projected into the joints of the bases of the cones, so the nucleus of the fire remains surrounded on all sides by $CO_2$ in the liquid state, which, in turn, is involved by the $CO_2$ in the gaseous state, to form a barrier zone of a diameter of approximately 30 meters, horizontally, and approximately 15 meters, vertically, above and below the said nucleus of fire. Extinction will be instantaneous.

In order to implement the process to extinguish fires in oil wells of the present invention, either in land or at sea, an Athey TM G type derrick is used in one embodiment, for placing the apparatus around the fire. A tank with $CO_2$ in the liquid state at 2,000 kPa and at −20 degrees centigrade (such tanks having a vacuum chamber between the liquid it contains in the reservoir and the external part in order to maintain the temperature and the pressure inside the reservoir) and a tank with $CO_2$ in the gaseous state, or a battery of bottles of $CO_2$ at 3,000 kPa or more are connected to the apparatus through hoses of flexible steel preferably through the jib of the derrick.

Three posts of topographic observation should be established in order to localize with precision the nucleus of fire. Once the discharge of the $CO_2$ in the gaseous and liquid states starts, the apparatus is moved toward the nucleus of the fire, so that the apparatus is not directly exposed to the high temperature of the nucleus and surrounding zones, and also to avoid the obstruction of the apparatus by crude bursts.

The final position of the apparatus to extinguish the fire is adjusted so the apparatus encircles the fire nucleus, and the vertical axis of the fire nucleus coincides with the main axis of apparatus 1 and the fire nucleus remains, at approximately half the height of the wall 4. When the feeding valves are totally opened in order to make a simultaneous application Of $CO_2$ in the liquid and gaseous states to encircle the nucleus of fire, the fire will be extinguished due to an isolating barrier formed as well as to the simultaneous cooling of the combustible. The valves will only be closed when the pulverizer is out of perpendicular alignment with the crude jet so that it can not penetrate inside the jet and obstruct its inlets.

The $CO_2$ in the liquid and gaseous states when expanded and projected, as described above, by the apparatus 1, under and around the nucleus of fire, encircles the fire nucleus at 360 degrees and completely isolates it from the atmospheric air, thereby causing the cooling of the nucleus of fire, and eliminating any possibility of auto-ignition. The $CO_2$ either in the liquid or gaseous states is sent to independent semicylindrical chambers.

The carbon dioxide in the liquid state must be at a pressure of 2,000 kPa, and the same gas in the gaseous state must be at 3,000 kPa, and must be regulated depending on the distance of the projection of the gas, and of the flow of gas in Kg/s so that the instantaneous extinction can occur.

The staff involved in this operation must use special clothes and masks which allow for autonomous breathing, as the injection of $CO_2$ to extinguish the fire will turn the atmosphere into a range from 20 to 30 meters which would result in suffocation.

I claim:

1. An apparatus for extinguishing fires in oil wells comprising:, three continuous walls, including an innermost wall, a middle wall and an outermost wall, said three walls having different diameters and arranged coaxially and concentrically with respect to each other to define an inner chamber between said innermost wall and said middle wall and an outer chamber between said middle wall and said outermost wall means for separating each of said inner chamber and said outer chamber into subchambers conical shaped covers connected to top and bottom edges of said walls, said covers funneling toward a center of said apparatus;

means for feeding a noncombustible fluid in a gaseous state to said outer chamber and a noncombustible fluid in a liquid state to said inner chamber.

2. The apparatus for extinguishing fires in oil wells, in accordance with claim 1, further comprising perforations through said outermost wall and perforations through said covers.

3. The apparatus for extinguishing fires in oil wells, in accordance with claim 1, wherein said means for separating separates said inner chamber into two inner subchambers and said outer chamber into two outer subchambers, said inner subchambers being displaced 90 degrees with respect to said outer subchambers.

4. The apparatus for extinguishing fires in oil wells, in accordance with claim 1 further comprising a plurality of tubular cannons and wherein said outer chamber is perforated by a first series of perforations radially positioned through said outermost wall, each of said perforations having dimensions sufficient to allow one of said plurality of tubular cannons to pass through said outer chamber are perforated by a second series of perforations radially positioned through all three walls, each of said perforations of said second series of perforations having dimensions sufficient to allow one of said plurality of tubular cannons to pass through said perforations of said second series.

5. The apparatus for extinguishing fires in oil wells, in accordance with claim 4, wherein a plurality of series of the said first series perforations are arranged in adjacent positions in a vertical direction and wherein a plurality of series of said second series of perforations are arranged in adjacent positions in a vertical direction.

6. The apparatus for extinguishing fires in oil wells, in accordance with claim 1 wherein said apparatus further comprises a support for joining said apparatus to a jib of a derrick.

* * * * *